US009216594B2

(12) United States Patent
Soda et al.

(10) Patent No.: US 9,216,594 B2
(45) Date of Patent: Dec. 22, 2015

(54) CONVEYOR DEVICE AND INKJET RECORDING APPARATUS

(71) Applicant: KYOCERA Document Solutions Inc., Osaka (JP)

(72) Inventors: Tomohisa Soda, Osaka (JP); Hidenori Takenaka, Osaka (JP); Jumpei Hobo, Osaka (JP); Masami Fujihara, Osaka (JP); Takeshi Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/674,750

(22) Filed: Mar. 31, 2015

(65) Prior Publication Data

US 2015/0273878 A1 Oct. 1, 2015

(30) Foreign Application Priority Data

Apr. 1, 2014 (JP) ..... 2014-075589

(51) Int. Cl.
*B41J 2/01* (2006.01)
*B41J 11/00* (2006.01)

(52) U.S. Cl.
CPC ..... *B41J 11/007* (2013.01); *B41J 11/0045* (2013.01); *B41J 11/0085* (2013.01)

(58) Field of Classification Search
CPC ..... B41J 11/007; B41J 11/06; B41J 11/02; B41J 13/08
USPC ..... 347/104
See application file for complete search history.

(56) References Cited

U.S. PATENT DOCUMENTS 8,303,104 B2 * 11/2012 Miyagi ..... B41J 2/16585 346/139 R
2003/0084811 A1 * 5/2003 Ishii ..... B41J 11/0065 101/494
2007/0126832 A1 * 6/2007 Kito ..... B41J 11/0065 347/101
2009/0219372 A1 * 9/2009 Igi ..... B41J 11/0015 347/104
2009/0262174 A1 * 10/2009 Toyoshima ..... 347/104
2010/0084803 A1 * 4/2010 Akihiro et al. ..... 271/3.22
2010/0117293 A1 * 5/2010 Shinohara ..... 271/264
2010/0214343 A1 * 8/2010 Yamaguchi et al. ..... 347/16
2011/0050825 A1 * 3/2011 Murata ..... B41J 11/007 347/104
2011/0242220 A1 * 10/2011 Yamagishi ..... B41J 11/06 347/47
2012/0069085 A1 * 3/2012 Yamagishi ..... B41J 2/1714 347/30

FOREIGN PATENT DOCUMENTS

JP 2010264624 A * 11/2010
JP 2012-051330 A 3/2012

* cited by examiner

*Primary Examiner* — Matthew Luu
*Assistant Examiner* — Patrick King
(74) *Attorney, Agent, or Firm* — Studebaker & Brackett PC

(57) ABSTRACT

A conveyor device is installed opposite to a recording head in a recording apparatus. The conveyor device includes a conveyor belt that conveys a recording medium. The conveyor device further includes a suction section. The suction section includes a guide member having through holes and an air escape channel. The guide member is located opposite to the recording head with the conveyor belt therebetween. The suction section sucks on the recording medium through the conveyor belt and the guide member. The guide member has a surface having grooves therein. The surface faces the recording head with the conveyor belt therebetween. The surface has a recess located outside of a region where the grooves are located. The recess constitutes a part of the air escape channel. The air escape channel is in communication with one or more of the grooves.

7 Claims, 18 Drawing Sheets

CONVEYOR DEVICE AND INKJET RECORDING APPARATUS

INCORPORATION BY REFERENCE

The present application claims priority under 35 U.S.C. §119 to Japanese Patent Application No. 2014-075589, filed Apr. 1, 2014. The contents of this application are incorporated herein by reference in their entirety.

BACKGROUND

The present disclosure relates to a conveyor device provided in a recording apparatus and an inkjet recording apparatus including the conveyor device.

An inkjet recording apparatus is a commonly known type of recording apparatus. Inkjet recording apparatuses are widely used in machines such as printers, copiers, and multifunction peripherals due to their compactness, low cost, and low operating noise. Inkjet recording apparatuses are broadly classified as being either a line head or a serial head type.

A line head inkjet recording apparatus includes a conveyor device that conveys a recording medium. The conveyor device generally includes a conveyor belt. The conveyor device is located opposite to a recording head and holds a recording medium on the conveyor belt while conveying the recording medium. The recording medium is held on the conveyor belt by using static electricity to attract the recording medium or negative pressure to suck the recording medium.

The conveyor device includes a suction section that sucks on the recording medium through the conveyor belt. The conveyor belt has a plurality of suction holes perforated therein. The suction section includes a guide member that supports the recording medium through the conveyor belt. The guide member has a plurality of through holes passing therethrough. Each of the through holes passes through the guide member in a thickness direction thereof. The guide member has a plurality of grooves into a surface thereof that faces the recording head. The through holes are located inside of the grooves into the guide member. The suction section includes an air flow chamber under the guide member. The suction section creates negative pressure in the air flow chamber. As such, the suction section sucks air through the suction holes in the conveyor belt and through the grooves and the through holes in the guide member. Through the above, the recording medium is sucked onto the conveyor belt.

Unfortunately, a configuration such as described above suffers the following problem. That is, when the conveyor belt is covered with a recording medium, pressure loss in the paths constituted by the grooves and the through holes of the guide member excessively increases to excessively increase the negative pressure in the air flow chamber. Such an excessive increase in negative pressure in the air flow chamber may excessively increase suction force for sucking the conveyor belt on the guide member to lead to unevenness in circulation speed of the conveyor belt. This is because the suction force for sucking the conveyor belt on the guide member acts as a load resistance against conveyance of the conveyor belt. Uneven circulation speed of the conveyor belt may cause ink droplets ejected from the recording head to land on points deviated from target positions, resulting in an artifact like printing shift or coloristic shift in an image formed on the recording medium.

By contrast, a guide member in another inkjet recording apparatus has a surface facing the conveyor belt in which transversely long grooves extend in terms of a direction perpendicular to the conveyance direction of the recording medium. The transversely long grooves lie between grooves that are adjacent to each other in the conveyance direction of the recording medium. The transversely long grooves extend up to one end of the guide member (end in terms of the direction perpendicular to the conveyance direction of the recording medium) so as to be in communication with air even when the conveyor belt is covered with the recording medium.

SUMMARY

A conveyor device according to an aspect of the present disclosure is for installation opposite to a recording head in a recording apparatus. The conveyor device includes a conveyor belt and a suction section. The conveyor belt conveys a recording medium. The suction section includes a guide member having a plurality of through holes and an air escape channel. The guide member is located opposite to the recording head with the conveyor belt therebetween. The suction section sucks on the recording medium through the conveyor belt and the guide member. The guide member has a surface having a plurality of grooves therein. The surface faces the recording head with the conveyor belt therebetween. The through holes are each located inside of a corresponding one of the grooves. The air escape channel is in communication with one or more of the grooves. The surface has a recess located outside of a region where the grooves are located. The recess constitutes a part of the air escape channel.

An inkjet recording apparatus according to another aspect of the present disclosure includes a recording head and the conveyor device described above. The recording head ejects ink droplets.

DETAILED DESCRIPTION

Figure 1:
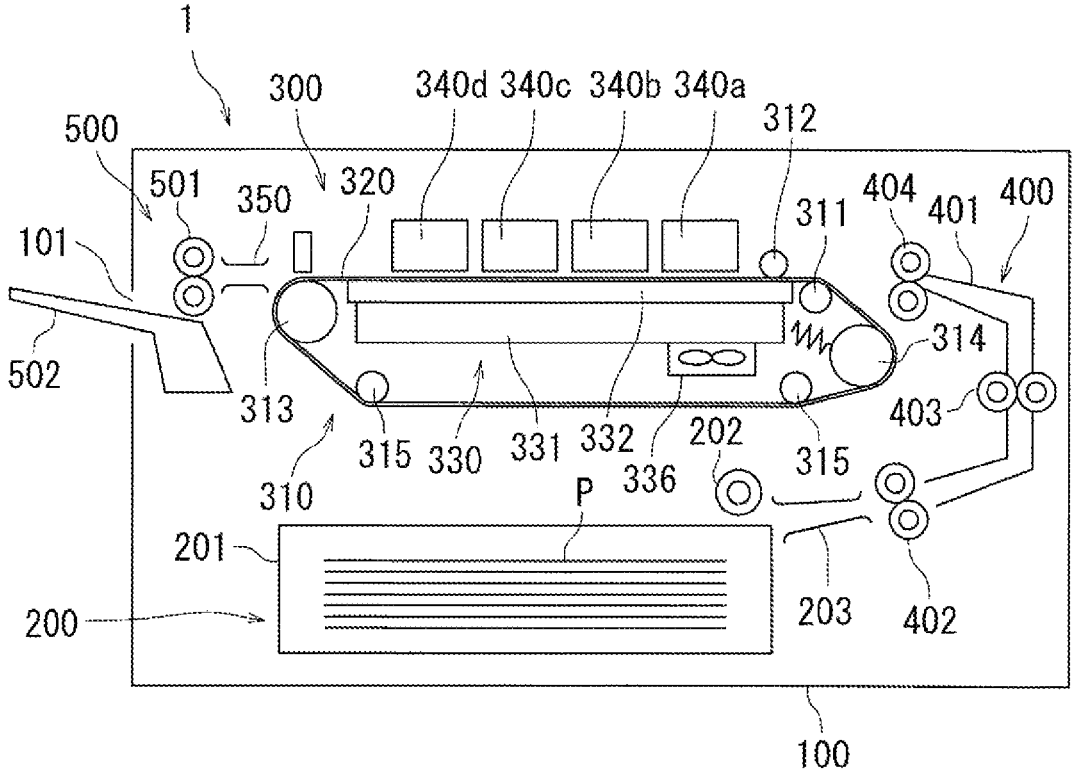
FIG. 1 illustrates configuration of an inkjet recording apparatus including a conveyor device according to a first embodiment of the present disclosure.

The following explains embodiments of the present disclosure with reference to the drawings. Elements that are the same or equivalent are indicated by the same reference signs in the drawings and explanation thereof is not repeated. The drawings are schematic illustrations that emphasize elements of configuration in order to facilitate understanding thereof. Therefore, in order that the elements can be easily illustrated in the drawings, properties of each of the elements, such as thickness, length, and number thereof, may differ from actual properties of the element. Also note that material properties, shapes, dimensions, and the like, described for each of the elements of configuration in the following embodiments, are only examples and are not intended to impose any particular limitations on the elements.

First Embodiment

Basic Configuration of Inkjet Recording Apparatus 1

FIG. 1 illustrates configuration of an inkjet recording apparatus 1 including a conveyor device 310 according to a first embodiment of the present disclosure.

The inkjet recording apparatus 1 (an example of a recording apparatus) includes a housing 100, a sheet feed section 200, an image forming section 300 that uses an inkjet recording method, a sheet conveying section 400, and a sheet ejecting section 500. The sheet feed section 200 is located in a lower section of the housing 100. The image forming section 300 is located above the sheet feed section 200. The sheet conveying section 400 is located at one side of the image forming section 300. The sheet ejecting section 500 is located at the other side of the image forming section 300.

The sheet feed section 200 includes a sheet feed cassette 201 that is freely detachable from the housing 100. The sheet feed section 200 also includes a sheet feed roller 202 and guide plates 203. The sheet feed roller 202 is located above the sheet feed cassette 201 at one end thereof. The guide plates 203 are located between the sheet feed roller 202 and the sheet conveying section 400.

The sheet feed cassette 201 contains a plurality of sheets of paper P (an example of a recording medium) in a stacked state. In the following explanation, a sheet of paper is simply referred to as a sheet. The sheet feed roller 202 (pickup roller) is a feed member that feeds the sheet P in the conveyance direction thereof. The sheet feed roller 202 picks up sheets P, one at a time, from the sheet feed cassette 201. The guide plates 203 guide the sheet P that has been picked up by the sheet feed roller 202 to the sheet conveying section 400.

The sheet conveying section 400 includes a sheet conveyance path 401 that is roughly C-shaped, a first pair of conveyance rollers 402 (primary sheet feed roller pair), a second pair of conveyance rollers 403 (secondary sheet feed roller pair), and a pair of registration rollers 404. The first pair of conveyance rollers 402 is located at an input end of the sheet conveyance path 401. The second pair of conveyance rollers 403 is located partway along the sheet conveyance path 401. The pair of registration rollers 404 is located at an output end of the sheet conveyance path 401. The sheet conveyance path 401 forms one section of a sheet conveyance path of the sheet P (an example of a recording medium conveyance path).

The first pair of conveyance rollers 402 is a feed member that feeds the sheet P in the conveyance direction thereof. The first pair of conveyance rollers 402 sandwiches the sheet P fed from the sheet feed section 200 therebetween and feeds the sheet P into the sheet conveyance path 401. The second pair of conveyance rollers 403 is also a feed member. The second pair of conveyance rollers 403 sandwiches the sheet P fed from the first pair of conveyance rollers 402 therebetween and feeds the sheet P in the sheet conveyance direction.

The pair of registration rollers 404 performs skew correction on the sheet P fed from the second pair of conveyance rollers 403. The pair of registration rollers 404 temporarily holds the sheet P stationary in order to synchronize conveyance of the sheet P with a timing at which image formation is to be performed on the sheet P. The pair of registration rollers 404 feeds the sheet P to the image forming section 300 in accordance with the timing of image formation on the sheet P.

The image forming section 300 includes the conveyor device 310, four types of line head 340*a*, 340*b*, 340*c*, and 340*d*, and a conveyance guide 350. The four types of line head 340*a*, 340*b*, 340*c*, and 340*d* are located above the conveyor device 310. The conveyance guide 350 is located downstream of the conveyor device 310 in terms of the conveyance direction of the sheet P. Although not illustrated in the drawings, each of the four types of line head 340*a*, 340*b*, 340*c*, and 340*d* includes a plurality of nozzles. The nozzles eject ink droplets to form an image, such as text or a diagram, on the sheet P. The image forming section 300 may also include a drying device. The drying device dries ink droplets that have landed onto the sheet P.

The conveyor device 310 includes a belt speed detecting roller 311, a sheet holding roller 312, a drive roller 313, a tension roller 314, a pair of guide rollers 315, an endless conveyor belt 320, and a suction section 330. The conveyor device 310 is located opposite to the four types of line head 340*a*, 340*b*, 340*c*, and 340*d* in the housing 100. The conveyor belt 320 is wound around the belt speed detecting roller 311, the drive roller 313, the tension roller 314, and the pair of guide rollers 315. The conveyor belt 320 is driven to convey the sheet P.

The conveyor belt 320 is for example made from a material such as polyimide (PI), polyamide-imide (PAI), polyvinylidene fluoride (PVDF), or polycarbonate (PC). Use of polyimide or polyamide-imide is preferable in terms of reducing unevenness in thickness of the conveyor belt 320. Also, a layer made from a rubber material such as ethylene propylene diene monomer (EPDM) rubber may be layered on a rear surface of the conveyor belt 320 (i.e., a surface facing the suction section 330). The conveyor belt 320 has a thickness of, for example, 100 μm.

The tension roller 314 ensures that the conveyor belt 320 does not sag by applying tensile force to the conveyor belt 320. The conveyor device 310 may include a mechanism that when meandering of the conveyor belt 320 occurs, changes the orientation of the axial center of the tension roller 314 in accordance with the meandering. Such a mechanism corrects the meandering of the conveyor belt 320.

The belt speed detecting roller 311 is located upstream relative to the suction section 330 in terms of the conveyance direction of the sheet P. The belt speed detecting roller 311 rotates due to friction generated between the belt speed detecting roller 311 and the conveyor belt 320. The belt speed detecting roller 311 includes a pulse plate (not illustrated) that rotates integrally with the belt speed detecting roller 311. The circulation speed of the conveyor belt 320 is detected by measuring the rotation speed of the pulse plate. Therefore, when unevenness in circulation speed of the conveyor belt 320 occurs, the unevenness can be corrected by controlling the rotation speed of the drive roller 313.

The drive roller 313 is located downstream relative to the suction section 330 in terms of the conveyance direction of the sheet P. Preferably the drive roller 313 is located such as to function in combination with the belt speed detecting roller 311 to maintain flatness of the conveyor belt 320. Such a configuration also maintains flatness of the conveyor belt 320 when meandering correction is performed on the conveyor belt 320.

The drive roller 313 is driven by a motor (not illustrated). In other words, the motor causes the drive roller 313 to rotate. When the drive roller 313 rotates, friction generated between the drive roller 313 and the conveyor belt 320 causes the conveyor belt 320 to circulate in a direction corresponding to counter clockwise in FIG. 1. The drive roller 313 has a diameter of, for example, 30.0 mm.

In a configuration in which correction of unevenness of speed of the conveyor belt 320 is performed by correcting rotation speed of the drive roller 313, the drive roller 313 preferably has a low moment of inertia. In other words, the drive roller 313 is preferably light. In consideration of the above, in the first embodiment the drive roller 313 is preferably a hollow pipe such as an aluminum pipe or a pipe having a three-spoke cross-section. In a configuration in which unevenness of speed of the conveyor belt 320 is not corrected, the drive roller 313 preferably has a large moment of inertia in order to stabilize rotation of the drive roller 313 through a flywheel effect. In other words, the drive roller 313 is preferably heavy. Therefore, in such a configuration the drive roller 313 is preferably made from a material such as solid metal.

In a configuration in which the conveyor belt 320 is made from a resinous material such as polyimide, a surface layer of the drive roller 313 is preferably made from a rubber material such as EPDM rubber, urethane rubber, or nitrile rubber. In a configuration in which the image forming section 300 forms an image on the sheet P using an aqueous ink, EPDM rubber is preferably used as a material of the surface layer of the drive roller 313 in order to prevent swelling of the rubber material. The surface layer made from the rubber material has a thickness of, for example, 1.0 mm. In a configuration in which a layer of a rubber material such as EPDM rubber is disposed over the rear surface of the conveyor belt 320, the surface layer of the drive roller 313 may be made from metal. In a configuration in which the surface layer of the drive roller 313 is made from aluminum, the surface of the drive roller 313 may be anodized in order to prevent abrasion.

The pair of guide rollers 315 is located lower than suction section 330. By positioning the pair of guide rollers 315 as described above, a space is formed under the suction section 330 and thus a section of the conveyor belt 320 that is located under the suction section 330 is prevented from coming into contact with the suction section 330. Also, a guide roller 315 among the pair of guide rollers 315 that is closer to the drive roller 313 maintains a degree to which the conveyor belt 320 is wound around the drive roller 313. A guide roller 315 among the pair of guide rollers 315 that is closer to the tension roller 314 maintains a degree to which the conveyor belt 320 is wound around the tension roller 314, thereby ensuring that meandering correction can be reliably performed.

The four types of line head 340*a*, 340*b*, 340*c*, and 340*d* are located in respective order from upstream to downstream in terms of the conveyance direction of the sheet P. The line heads 340*a*, 340*b*, 340*c*, and 340*d* each include a plurality of nozzles (not illustrated) that are arranged in a width direction of the conveyor belt 320 (i.e., a direction perpendicular to the conveyance direction of the sheet P). In other words, the inkjet recording apparatus 1 is a line head inkjet recording apparatus.

The following explains a generic line head inkjet recording apparatus. In order to eject ink droplets of a single color toward a recording medium, the line head inkjet recording apparatus includes a single recording head having a greater width than the recording medium. Alternatively, the line head inkjet recording apparatus may include a plurality of recording heads that are arranged in terms of a direction perpendicular to the conveyance direction of the recording medium (i.e., arranged in a width direction of the recording medium). In a configuration in which the inkjet recording apparatus ejects ink droplets of a plurality of different colors, the inkjet recording apparatus includes either a single recording head or a group of recording heads for each of the colors, and the recording heads for the respective colors are arranged in the conveyance direction of the recording medium. The recording heads are fixed in place and the recording medium is conveyed under the recording heads. The recording heads form an image on the recording medium by ejecting ink droplets onto the recording medium while the recording medium is being conveyed. Note that in a serial head inkjet recording apparatus, a recording medium is held stationary partway along a recording medium conveyance path and recording heads eject ink droplets onto the stationary recording medium while moving.

The following resumes explanation of the inkjet recording apparatus 1 according to the first embodiment. The line head 340*a* includes a plurality of nozzles that are each in communication with a pressure chamber (not illustrated) located within a recording head. The pressure chamber is in communication with an ink chamber (not illustrated) located within the recording head. The ink chamber is in communication with a black (Bk) ink tank (not illustrated) via an ink supply tube (not illustrated). In other words, the ink chamber is connected to the black ink tank.

The line head 340*b* includes a plurality of nozzles that are each in communication with a pressure chamber (not illustrated) located within a recording head. The pressure chamber is in communication with an ink chamber (not illustrated) located within the recording head. The ink chamber is in communication with a cyan (C) ink tank (not illustrated) via an ink supply tube (not illustrated). In other words, the ink chamber is connected to the cyan ink tank.

The line head 340*c* includes a plurality of nozzles that are each in communication with a pressure chamber (not illustrated) located within a recording head. The pressure chamber is in communication with an ink chamber (not illustrated) located within the recording head. The ink chamber is in communication with a magenta (M) ink tank (not illustrated) via an ink supply tube (not illustrated). In other words, the ink chamber is connected to the magenta ink tank.

The line head 340*d* includes a plurality of nozzles that are each in communication with a pressure chamber (not illustrated) located within a recording head. The pressure chamber is in communication with an ink chamber (not illustrated) located within the recording head. The ink chamber is in communication with a yellow (Y) ink tank (not illustrated) via an ink supply tube (not illustrated). In other words, the ink chamber is connected to the yellow ink tank.

The suction section 330 faces the rear surface of the conveyor belt 320 such as to be located opposite to the four types of line head 340*a*, 340*b*, 340*c*, and 340*d* with the conveyor belt 320 therebetween. The suction section 330 includes an air flow chamber 331 (an example of a gas flow chamber), a guide member 332 that covers an upper surface aperture of the air flow chamber 331, and a suction device 336. The guide member 332 supports the sheet P through the conveyor belt 320.

The sheet holding roller 312 is a driven roller. The sheet holding roller 312 is located opposite to the guide member 332 with the conveyor belt 320 therebetween. The sheet holding roller 312 guides a sheet P that has been fed from the pair of registration rollers 404 onto the conveyor belt 320 and causes the sheet P to be sucked onto the conveyor belt 320.

The sheet holding roller 312 preferably has a small moment of inertia in order to soften impact vibration generated by the sheet P impacting with the sheet holding roller 312. In other words, the sheet holding roller 312 is preferably light. The sheet holding roller 312 is for example preferably a hollow pipe such as an aluminum pipe or a pipe having a three-spoke cross-section. In a configuration in which the sheet holding roller 312 is made from aluminum, the surface of the sheet holding roller 312 may be anodized in order to prevent abrasion.

In the first embodiment, pressing force that presses the sheet holding roller 312 toward the conveyor belt 320 (i.e., toward the guide member 332) is applied to the sheet holding roller 312. Through the above configuration, even when there is a disparity between the conveyance speed of the sheet P by the pair of registration rollers 404 and the circulation speed of the conveyor belt 320, a position at which close contact between the sheet P and the conveyor belt 320 begins can be made to correspond to a position at which the sheet holding roller 312 is located.

The suction device 336 is for example a fan. However, the suction device 336 is not limited to being a fan and may for example be a vacuum pump instead. While the suction device 336 is being operated, the suction section 330 sucks on the sheet P through the conveyor belt 320.

The conveyance guide 350 guides the sheet P to the sheet ejecting section 500 upon the sheet P being ejected from the conveyor belt 320. The sheet ejecting section 500 includes a pair of ejection rollers 501 and an exit tray 502. The exit tray 502 is fixed to the housing 100 such as to project outward from an exit port 101 formed in the housing 100.

Once the sheet P has passed through the conveyance guide 350, the sheet P is fed toward the exit port 101 by the pair of ejection rollers 501 and is guided onto the exit tray 502. As a result, the sheet P is ejected externally from the housing 100 through the exit port 101.

The air flow chamber 331 is formed by a box-shaped member having a covered bottom end and an open top end. The suction device 336 is located under the air flow chamber 331. A bottom wall of the box-shaped member forming the air flow chamber 331 has a gas outlet (not illustrated) corresponding to the suction device 336. The suction device 336 is connected to a power source (not illustrated). Operation of the suction device 336 creates negative pressure in the air flow chamber 331. The negative pressure causes sucking on the sheet P through the conveyor belt 320.

Figure 2:
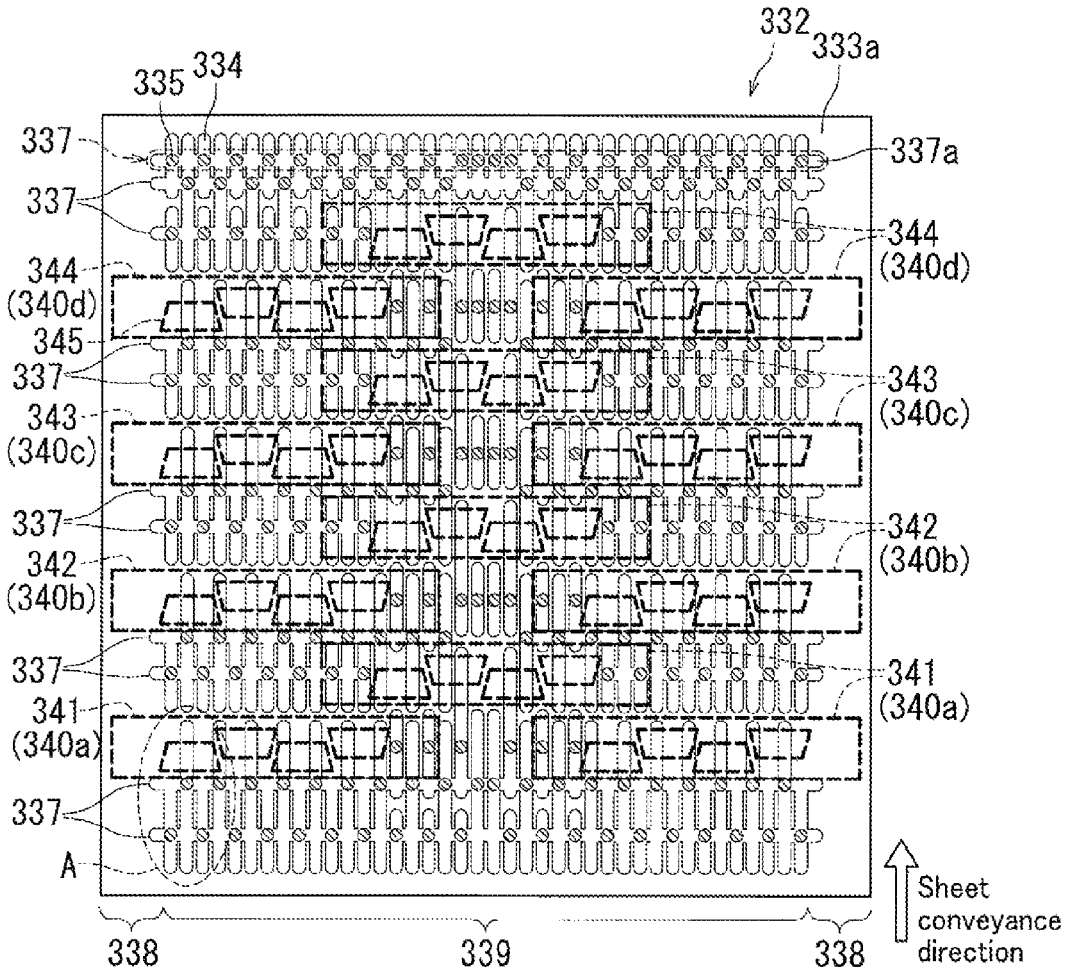
FIG. 2 is a plan view illustrating a guide member according to the first embodiment of the present disclosure.

FIG. 2 is a plan view of the guide member 332. FIG. 2 illustrates positional relationship of the guide member 332 and the four types of line head 340*a*, 340*b*, 340*c*, and 340*d*. Note that the conveyor belt 320 is not illustrated in FIG. 2 in order to facilitate understanding.

As illustrated in FIG. 2, the line head 340*a* for black (Bk) includes three recording heads 341. The three recording heads 341 are arranged in the width direction of the guide member 332 (i.e., a direction perpendicular to the sheet conveyance direction) in a staggered formation.

The line head 340*b* for cyan (C) includes three recording heads 342. The three recording heads 342 are arranged in the width direction of the guide member 332 (i.e., the direction perpendicular to the sheet conveyance direction) in a staggered formation.

The line head 340*c* for magenta (M) includes three recording heads 343. The three recording heads 343 are arranged in the width direction of the guide member 332 (i.e., the direction perpendicular to the sheet conveyance direction) in a staggered formation.

The line head 340*d* for yellow (Y) includes three recording heads 344. The three recording heads 344 are arranged in the width direction of the guide member 332 (i.e., the direction perpendicular to the sheet conveyance direction) in a staggered formation.

Figure 3:
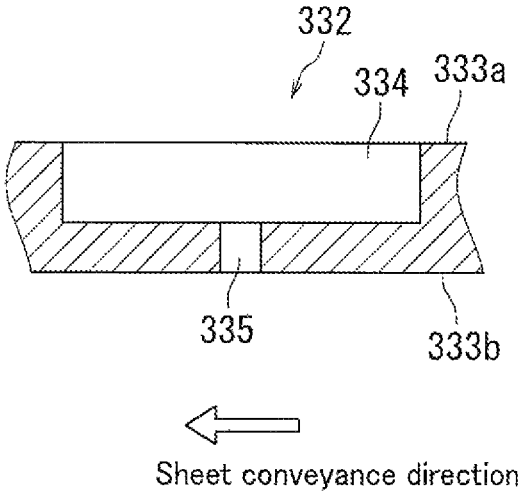
FIG. 3 is a cross sectional view illustrating a groove and a through hole of the guide member according to the first embodiment of the present disclosure.

The guide member 332 has a plurality of grooves 334 into a surface 333*a* of the surfaces thereof. The surfaces 333*a* is hereinafter referred to as an obverse surface 333*a*. The obverse surface 333*a* faces the line heads 340*a*-340*d* (i.e., the recording heads 341-344). The grooves 334 each have a rod-like shape with rounded ends that extends in the sheet conveyance direction. FIG. 3 is a cross sectional view illustrating a groove 334 and a through hole 335 in the guide member 332. As illustrated in FIGS. 2 and 3, for each of the plurality of grooves 334, the guide member 332 has a corresponding through hole 335 that runs through the guide member 332 in a thickness direction thereof. Each of the through holes 335 has a circular cross section. The guide member 332 further has air escape channels 337. The air escape channels 337 will be described later in detail.

Figure 4:
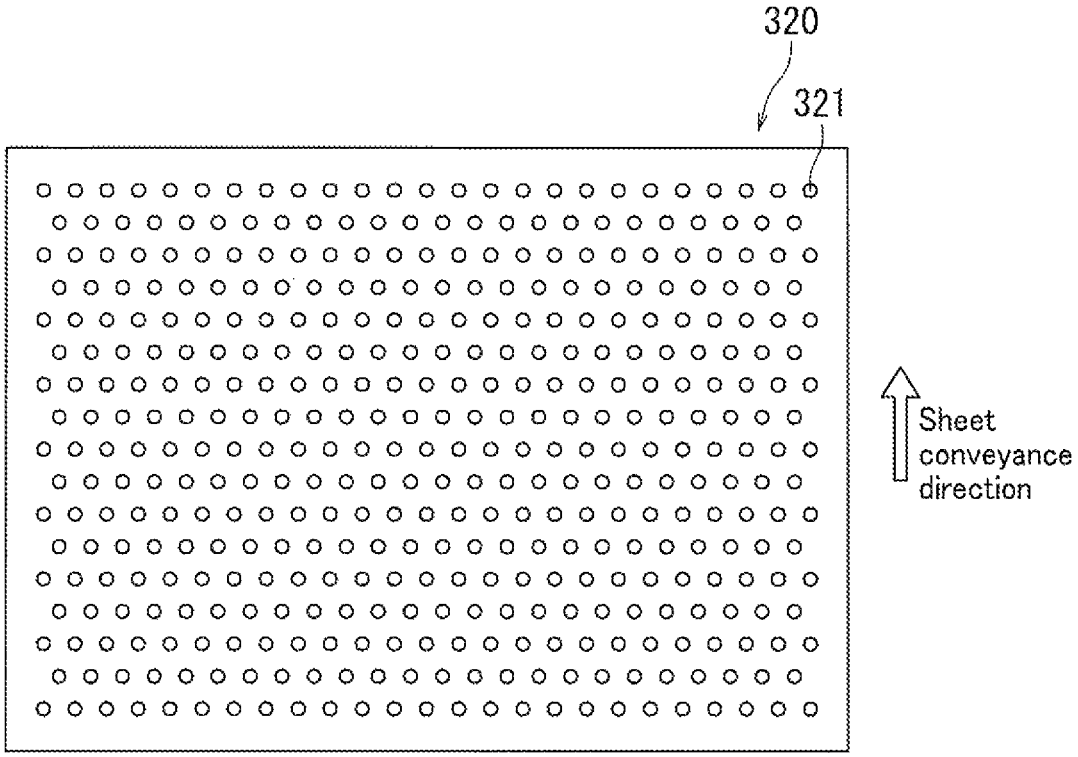
FIG. 4 is a plan view illustrating a conveyor belt according to the first embodiment of the present disclosure.

FIG. 4 is a plan view illustrating the conveyor belt 320. As illustrated in FIG. 4, the conveyor belt 320 has a plurality of suction holes 321 that are perforated through the conveyor belt 320. The suction holes 321 each have a diameter of, for example, 2 mm. The spacing between adjacent suction holes 321 is, for example, 8 mm.

A plurality of columns that each include a plurality of the suction holes 321 arranged in the sheet conveyance direction are arranged in the width direction of the conveyor belt 320 (i.e., the direction perpendicular to the sheet conveyance direction) such that the suction holes 321 are arranged in a staggered formation. By contrast, as illustrated in FIG. 2, A plurality of columns that each include a plurality of the grooves 334 arranged in the sheet conveyance direction are arranged in the width direction of the guide member 332 (i.e., the direction perpendicular to the sheet conveyance direction). The columns of the suction holes 321 in the conveyor belt 320 are arranged such as to correspond to the columns of the grooves 334 in the guide member 332. As such, the suction holes 321 in the conveyor belt 320 overlap with the grooves 334 of the guide member 332.

Each of the grooves 334 is located such as to be opposite to at least two of the suction holes 321. The suction holes 321 that are opposite to the groove 334 change one-by-one as the conveyor belt 320 circulates.

The air flow chamber 331 (see FIG. 1) is located adjacent to the other surface 333*b* (see FIG. 3) of the guide member 332. The surface 333*b* is hereinafter referred to as a reverse surface 333*b*. The reverse surface 333*b* is located on the opposite side of the obverse surface 333*a* (see FIG. 3). The air flow chamber 331 is in communication with the suction holes 321 (see FIG. 4) in the conveyor belt 320 through the through holes 335 (see FIG. 2) and the grooves 334 (see FIG. 2) in the guide member 332.

[Operation of Inkjet Recording Apparatus 1]

The following explains operation of the inkjet recording apparatus 1 with reference to FIG. 1. A sheet P is picked up from the sheet feed cassette 201 by the sheet feed roller 202. The picked-up sheet P is guided to the first pair of conveyance rollers 402 by the guide plates 203. In a situation in which a plurality of sheets P are stacked in the sheet feed cassette 201, an uppermost sheet P in the stack is picked up from the sheet feed cassette 201 by the sheet feed roller 202.

The sheet P is fed into the sheet conveyance path 401 by the first pair of conveyance rollers 402 and is then conveyed in the sheet conveyance direction by the second pair of conveyance rollers 403. The sheet P stops upon coming into contact with the pair of registration rollers 404. Through the above, skew correction is performed on the sheet P. The sheet P is subsequently fed to the image forming section 300 in synchronization with timing of image formation.

The sheet P is guided and caused to be sucked onto the conveyor belt 320 by the sheet holding roller 312. Preferably the sheet P is guided onto the conveyor belt 320 such that the center of the sheet P in terms of the width direction thereof coincides with the center of the conveyor belt 320 in terms of the width direction thereof. The sheet P covers a portion of the suction holes 321 in the conveyor belt 320. The suction section 330 sucks air (an example of a gas) through the through holes 335 and the grooves 334 in the guide member 332 and the suction holes 321 in the conveyor belt 320. In other words, the suction section 330 creates negative pressure in the air flow chamber 331. The negative pressure acts on the sheet P, thereby sucking the sheet P onto the conveyor belt 320. The sheet P is conveyed in the sheet conveyance direction as the conveyor belt 320 circulates.

The conveyor belt 320 conveys each portion of the sheet P, in turn, to positions opposite to the four types of line head 340*a*, 340*b*, 340*c*, and 340*d* (recording heads 341-344). During the aforementioned conveyance, each of the four types of line head 340*a*, 340*b*, 340*c*, and 340*d* (recording heads 341-344) ejects ink droplets of the corresponding color toward the sheet P. Through the above process, an image is formed on the sheet P.

The sheet P is conveyed from the conveyor belt 320 to the conveyance guide 350. Once the sheet P has passed through the conveyance guide 350, the sheet P is fed toward the exit port 101 by the pair of ejection rollers 501 and is guided onto the exit tray 502. As a result, the sheet P is ejected externally from the housing 100 through the exit port 101.

In the line head inkjet recording apparatus 1 explained above, the line heads 340*a*, 340*b*, 340*c*, and 340*d* (recording heads 341-344) are fixed in place. The sheet P is conveyed under the line heads 340*a*, 340*b*, 340*c*, and 340*d* (recording heads 341-344). Therefore, the recording rate of the inkjet recording apparatus 1 can be increased by increasing the conveyance speed of the sheet P. For example, the conveyance speed of the sheet P in the inkjet recording apparatus 1 can be set at 900 mm/s. Also, in a situation in which A4 size paper P is conveyed with a long edge thereof orientated perpendicularly to the conveyance direction, the inkjet recording apparatus 1 can for example have a printing rate of 150 sheets per minute.

[Configuration of Guide Member 332]

As illustrated in FIG. 2, the guide member 332 has a plurality of air escape channels 337. The air escape channels 337 are each in communication with one or more of the grooves 334. The air escape channels 337 in the first embodiment each intersect with one or more of the grooves 334 in terms of the direction perpendicular to the sheet conveyance direction. The air escape channels 337 extend in terms of the direction perpendicular to the sheet conveyance direction in the guide member 332 illustrated in FIG. 2.

Each of the air escape channels 337 has a recess 337*a* at at least one end portion thereof into the obverse surface 333*a* of the guide member 332. The recesses 337*a* are located either one of end portions 338 (end portions in terms of the direction perpendicular to the sheet conveyance direction) of the guide member 332. Each of the recesses 337*a* is in communication with air. Each of the end portions 338 of the guide member 332 is a region beside a region (groove locating region) 339 in which the grooves 334 are located. The groove locating region 339 is set such as to correspond to a range (a predetermined medium passing range) where a sheet P having a maximum size on which the inkjet recording apparatus 1 can form an image passes.

In the above configuration, unevenness in circulation speed of the conveyor belt 320 can hardly occurs. Uneven circulation speed of a conveyor belt may be accompanied by an increase in area where a sheet covers the conveyor belt as the sheet is conveyed. Specifically, such an increase in area where the sheet covers the conveyor belt increases pressure loss in a flow path constituted by a groove and a through hole in a guide member, thereby increasing negative pressure in the air flow chamber. As a result, force (suction force) for sucking on the conveyor belt onto the guide member increases. The suction force acts as a load resistance against conveyance by the conveyor belt. Through the above, variation in the suction force causes unevenness in circulation speed of the conveyor belt.

By contrast, even when the conveyor belt 320 is covered with a sheet P, air can be allowed to flow into the air flow chamber 331 through the air escape channels 337 in the first embodiment. Specifically, the air flows into the grooves 334 located within a region covered with the sheet P through the air escape channels 337. This can allow air to flow into the air flow chamber 331 through the through holes 335 within the region covered with the sheet P. Thus, an excessive increase in negative pressure in the air flow chamber 331 can be suppressed. As a result, unevenness in the circulation speed of the conveyor belt 320 can be hard to occur. Less occurrence of unevenness in circulation speed of the conveyor belt 320 can result in that the landing positions of ink droplets ejected from the recording heads 341-344 can be less deviated from target positions. In consequence, an artifact like printing shift or coloristic shift can be hard to appear in an image formed on the sheet P.

Further, unevenness in circulation speed of the conveyor belt 320 tends to occur especially in a situation in which a sheet P covers all suction holes 321 in the conveyor belt 320 that are located opposite to the groove locating region 339 of the guide member 332. By contrast, the end portions (recesses 337*a*) of the air escape channels 337 are located outside of the groove locating region 339 of the guide member 332. Thus, air can be allowed to flow into the air escape channels 337 from the region of the guide member 332 that is not covered with the sheet P. In consequence, even when all suction holes 321 that are opposite to the groove locating region 339 of the guide member 332 are covered with a sheet P, air can be allowed to flow into the grooves 334 through the recesses 337*a* of the air escape channels 337. This configuration can allow air to flow into the air flow chamber 331, thereby suppressing an excessive increase in negative pressure in the air flow chamber 331.

Figure 5:
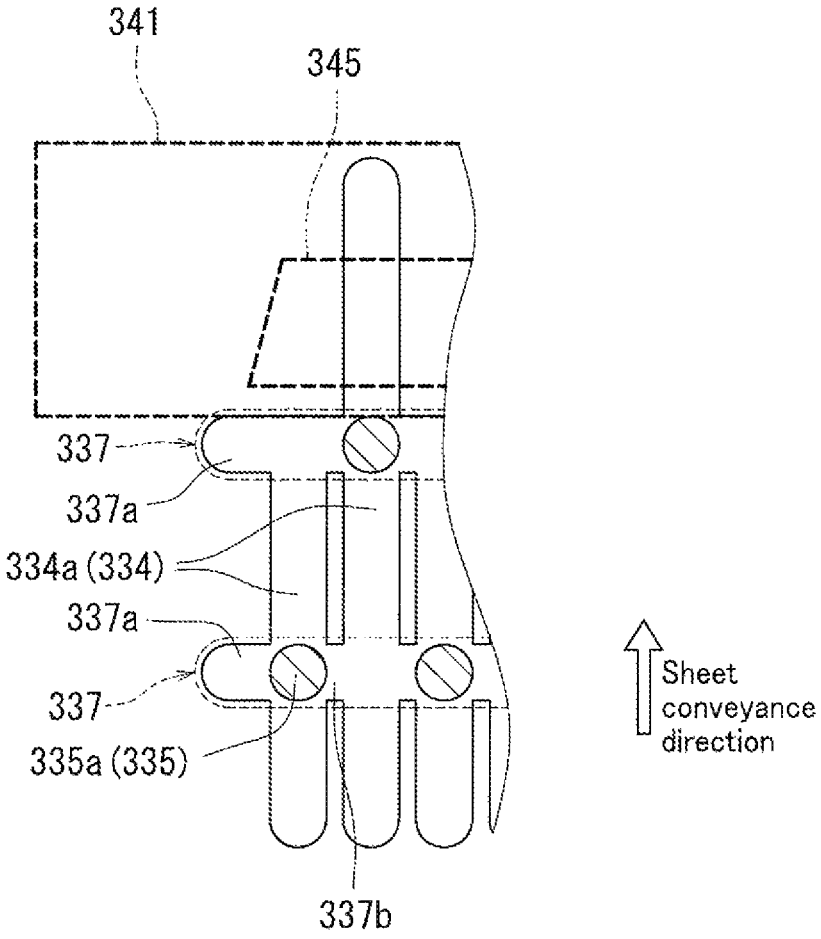
FIG. 5 is a plan view illustrating section A of FIG. 2.

FIG. 5 is a plan view illustrating section A of FIG. 2. In other words, FIG. 5 is an enlarged view of a section of the guide member 332. Note that the conveyor belt 320 is not illustrated in FIG. 5 in order to facilitate understanding. As illustrated in FIG. 5, the air escape channels 337 each have air escape grooves 337*b*. Each of the air escape grooves 337*b* is providing communication between grooves 334*a* that are adjacent to each other in terms of the direction perpendicular to the sheet conveyance direction among the plurality of grooves 334.

The air escape channels 337 are preferably formed so as to cause small pressure loss as far as possible. The smaller the pressure loss in the air escape channels 337 is, the more readily air can flow into the air flow chamber 331 through the air escape channels 337. The pressure loss in the air escape channels 337 is made smaller by making the distance to the through holes 335 shorter. As illustrated in FIGS. 2 and 5, each of the air escape channels 337 in the first embodiment overlaps with at least a portion (through holes 335*a*) of the through holes 335. This can make pressure loss in the air escape channels 337 small, thereby allowing air flow to flow more readily into the air flow chamber 331 through the air escape channels 337. Note that in a situation in which design requirements restrain the air escape channels 337 from overlapping with the through holes 335, the air escape channels 337 are preferably arranged closely to the through holes 335 as far as possible.

Further, as illustrated in FIGS. 2 and 5, each head surface of the recording heads 341, 342, 343, and 344, which faces to the conveyor belt 320, includes ejection regions 345 in which the nozzle orifices are formed.

Figure 6:
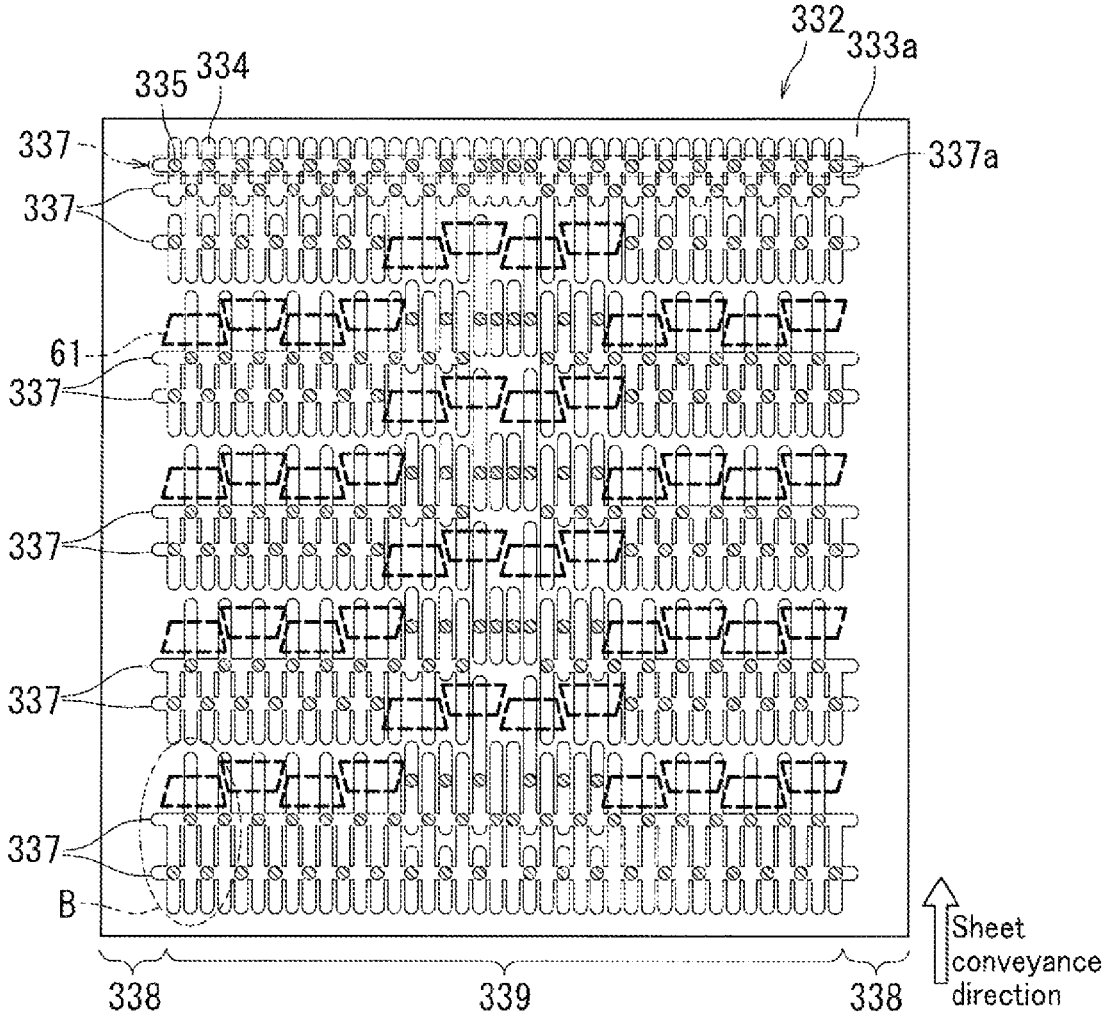
FIG. 6 is a plan view illustrating the guide member according to the first embodiment of the present disclosure.
Figure 7:
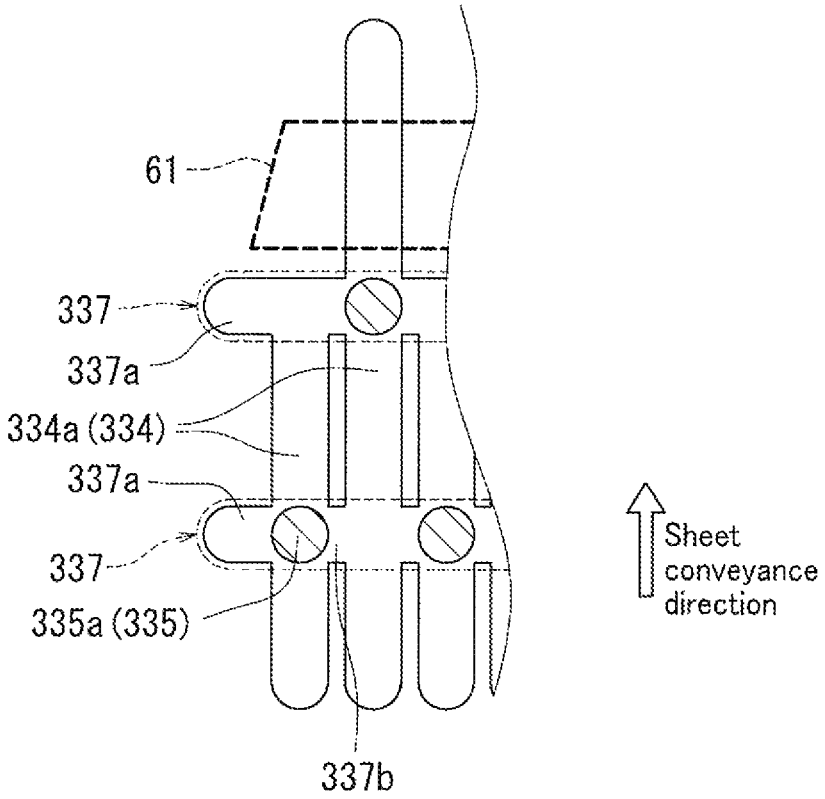
FIG. 7 is a plan view illustrating section B of FIG. 6.

FIG. 6 is a plan view illustrating the guide member 332. FIG. 7 is a plan view illustrating section B of FIG. 6. In other words, FIG. 7 is an enlarged view of one section of the guide member 332.

As illustrated in FIGS. 6 and 7, the air escape channels 337 in the first embodiment are located outside of nozzle facing regions 61. The nozzle facing regions 61 each face a corresponding one of the ejection regions 345 of the recording heads 341, 342, 343, and 344 explained with reference to FIGS. 2 and 5. This configuration can make the suction air flow generated under the ejection regions 345 of the head surfaces small. As a result, ink droplets can land on points less deviated from target positions. The suction air flow is generated in a manner that air is sucked into the air flow chamber 331 through the grooves 334 and the through holes 335 in the guide member 332 and the suction holes 321 in the conveyor belt 320.

Furthermore, as illustrated in FIGS. 2 and 6, the air escape channels 337 may extend from one of the end portions 338 to the other end portion 338 of the guide member 332. In this case, both the opposite end portions of the air escape channels 337 each are the recess 337*a*. Alternatively, as illustrated in FIGS. 2 and 6, any of the air escape channels 337 may extend from one of the end portions 338 to the central part of the guide member 332. In such a configuration, the center end portions of the air escape channels 337 in the central part of the guide member 332 are preferably located within a region covered with a sheet P having a minimum size on which the inkjet recording apparatus 1 can form an image. This configuration can allow air to flow into the grooves 334 and the through holes 335 in the guide member 332 that are located in the range covered with the minimum-sized sheet P through the air escape channels 337. In consequence, even in conveying a minimum-sized sheet P, an increase in negative pressure in the air flow chamber 331 can be suppressed, thereby hardly causing unevenness in circulation speed of the conveyor belt 320.

The sectional area of each of the air escape channels 337 is desirably greater than that of grooves 334 (334*a*) that are in communication with the air escape channels 337 among the plurality of grooves 334. This configuration can make pressure loss in the air escape channels 337 small.

Figure 8A:
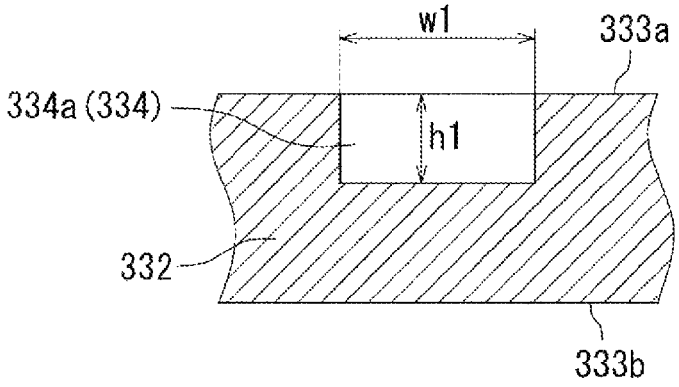
FIG. 8A is a cross sectional view illustrating a groove of the guide member according to the first embodiment of the present disclosure.
Figure 8B:
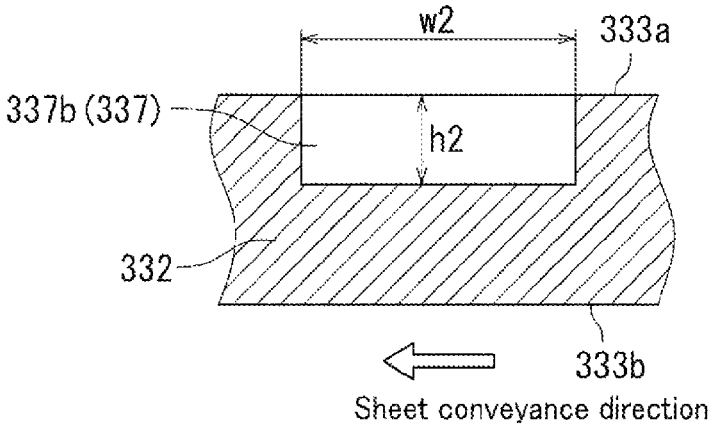
FIG. 8B is a cross sectional view illustrating an air escape channel of the guide member according to the first embodiment of the present disclosure.
Figure 8C:
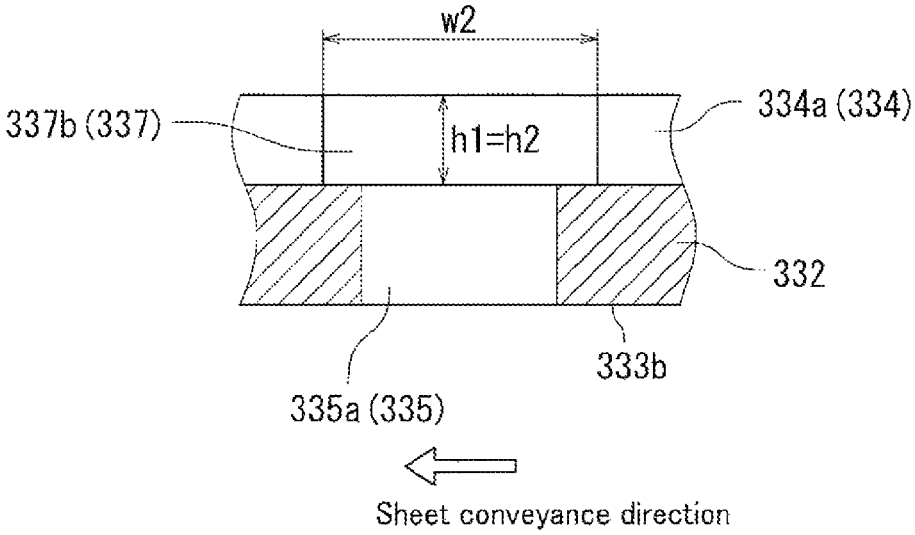
FIG. 8C is a cross sectional view illustrating the groove and the air escape channel of the guide member according to the first embodiment of the present disclosure.

FIG. 8A is a cross sectional view of a groove 334*a*. Specifically, FIG. 8A illustrates a groove 334*a* as viewed in the sheet conveyance direction. FIG. 8B is a cross sectional view of an air escape channel 337 (air escape groove 337*b*). Specifically FIG. 8B illustrates an air escape channel 337 (air escape groove 337*b*) as viewed in the direction perpendicular to the sheet conveyance direction. FIG. 8C is a cross sectional view of a groove 334*a* and an air escape channel 337 (air escape groove 337*b*). Specifically FIG. 8C illustrates a section where a groove 334*a* intersects with an air escape channel 337 as viewed in the direction perpendicular to the sheet conveyance direction.

As illustrated in FIGS. 8A, 8B, and 8C, a width w1 of the groove 334*a* is narrower than a width w2 of the air escape groove 337*b*. By contrast, a height h1 of the groove 334*a* is the same as a height h2 of the air escape groove 337*b*. The air escape groove 337*b* accordingly has a sectional area greater than the groove 334*a*. This configuration can make pressure loss in the air escape channels 337 small.

Figure 9A:
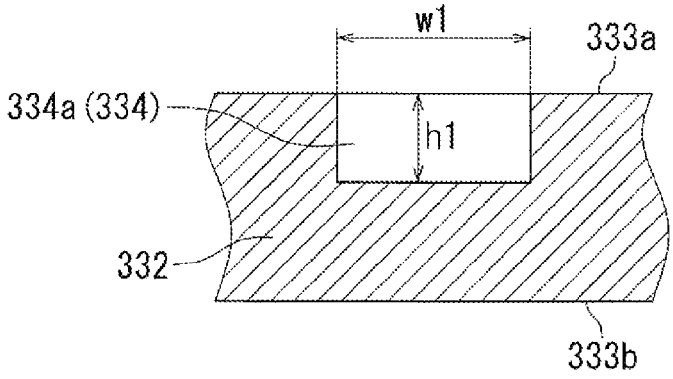
FIG. 9A is a cross sectional view illustrating another example of the groove of the guide member according to the first embodiment of the present disclosure.
Figure 9B:
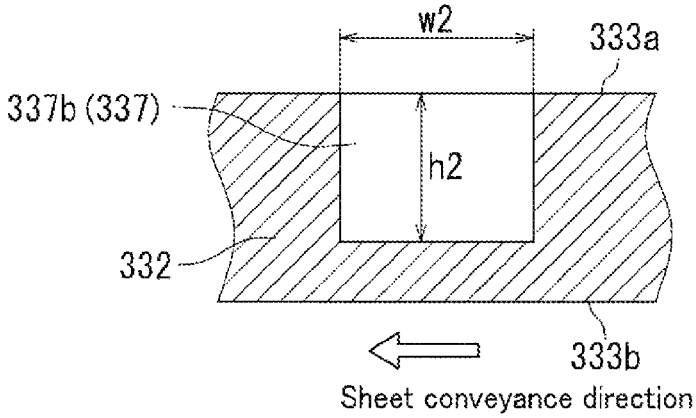
FIG. 9B is a cross sectional view illustrating another example of the air escape channel of the guide member according to the first embodiment of the present disclosure.
Figure 9C:
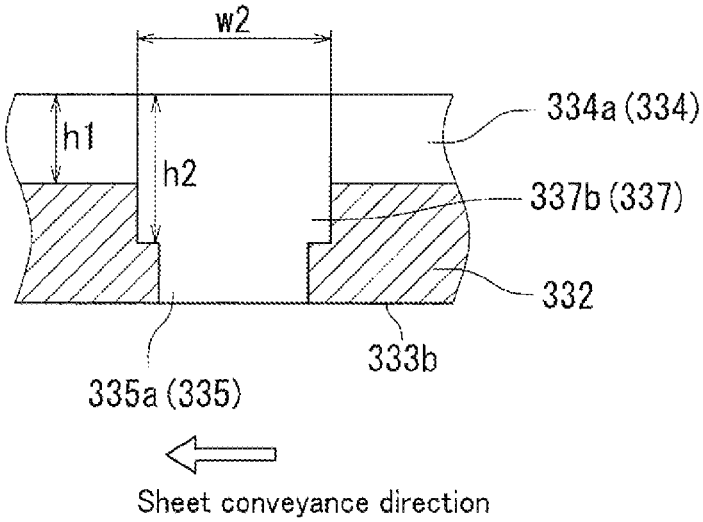
FIG. 9C is a cross sectional view illustrating the other example of the groove and the other example of the air escape channel of the guide member according to the first embodiment of the present disclosure.

FIG. 9A is a cross sectional view of another example of the groove 334*a*. Specifically, FIG. 9A illustrates another example of the groove 334*a* as viewed in the sheet conveyance direction. FIG. 9B is a cross sectional view of another example of the air escape channel 337 (air escape groove 337*b*). Specifically FIG. 9B illustrates another example of the air escape channel 337 (air escape groove 337*b*) as viewed in the direction perpendicular to the sheet conveyance direction. FIG. 9C is a cross sectional view of each of the other examples of the groove 334*a* and the air escape channels 337 (air escape groove 337*b*). Specifically FIG. 9C illustrates a section where a groove 334*a* intersects with an air escape channel 337 as viewed in the direction perpendicular to the sheet conveyance direction.

As illustrated in FIGS. 9A, 9B, and 9C, the height h1 of the groove 334*a* may be lower than the height h2 of the air escape groove 337*b*, and the width w1 of the groove 334*a* may be the same as the width w2 of the air escape groove 337*b*. The air escape groove 337*b* accordingly has a sectional area greater than the groove 334*a*. Thus, pressure loss can be made small in the air escape channels 337.

Figure 10A:
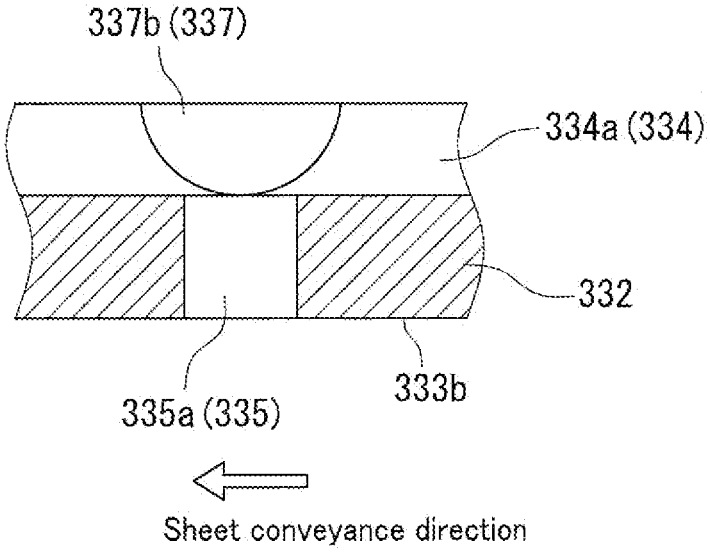
FIG. 10A is a cross sectional view illustrating a variation of the air escape channel of the guide member according to the first embodiment of the present disclosure.
Figure 10B:
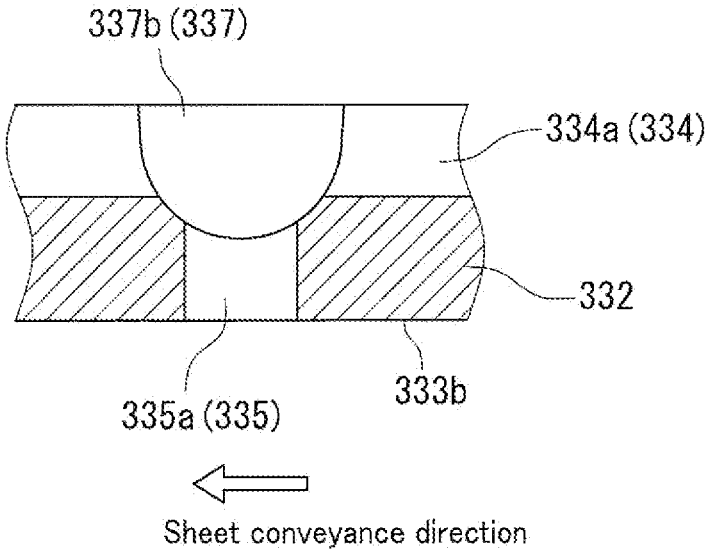
FIG. 10B is a cross sectional view illustrating a variation of the air escape channel of the guide member according to the first embodiment of the present disclosure.

Note that while the air escape grooves 337*b* (air escape channels 337) each may have, but not limited to having, a rectangular cross-section as illustrated in FIGS. 8B and 9B. FIG. 10A is a cross sectional view of a variation of the air escape channel 337 (air escape groove 337*b*). Specifically, FIG. 10A illustrates a section where a groove 334*a* intersects with an air escape channel 337 as viewed in the direction perpendicular to the sheet conveyance direction. As illustrated in FIG. 10A, the air escape groove 337*b* may have a semicircle shape in cross section. FIG. 10B is a cross sectional view of another variation of the air escape channel 337 (air escape groove 337*b*). Specifically FIG. 10B illustrates a section where a groove 334*a* intersects with an air escape channel 337 as viewed in the direction perpendicular to the sheet conveyance direction. As illustrated in FIG. 10B, the air escape groove 337*b* may have a shape of a part of an extended ellipse at one end potion.

Figure 11:
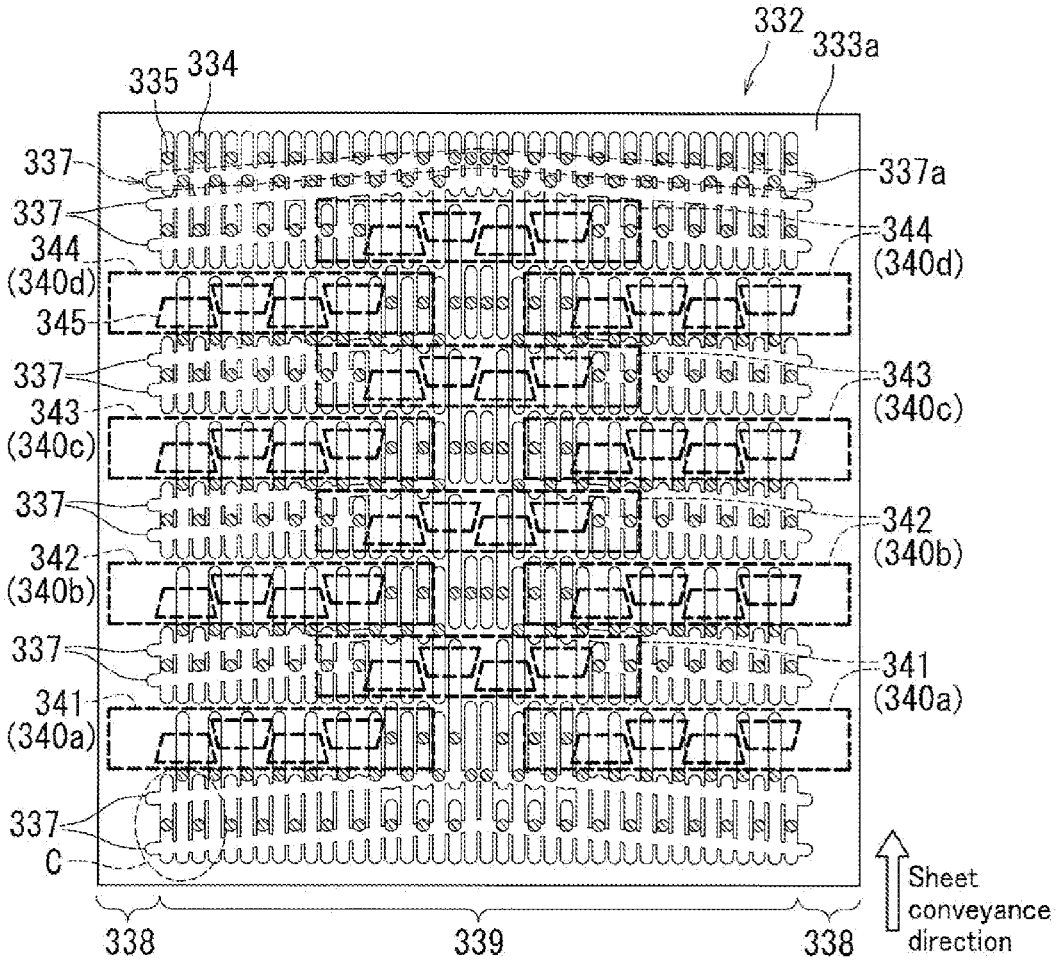
FIG. 11 is a plan view illustrating a variation of the guide member according to the first embodiment of the present disclosure.
Figure 12:
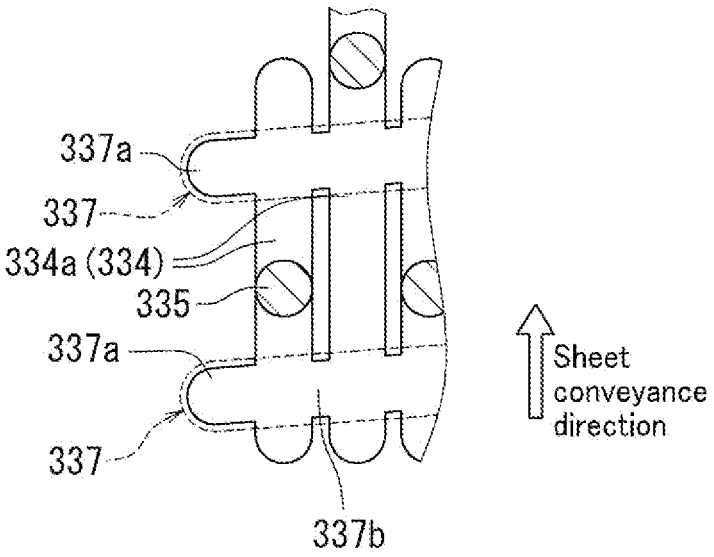
FIG. 12 is a plan view illustrating section C of FIG. 11.

Yet, the air escape channels 337 in the guide member 332 illustrated in FIGS. 2 and 6 extend in the direction perpendicular to the sheet conveyance direction. However, the direction in which the air escape channels 337 extend is not limited. It is only required that each of the air escape channels 337 intersects with one or more of the plurality of grooves 334. FIG. 11 is a plan view of a variation of the guide member 332. FIG. 12 is a plan view illustrating section C of FIG. 11. In other words, FIG. 12 is an enlarged view of a section of the guide member 332 in the variation. In the guide member 332 illustrated in FIGS. 11 and 12, the air escape channels 337 extend in an oblique direction relative to the sheet conveyance direction. This configuration can also prevent an excessive increase in negative pressure in the air flow chamber 331 to hardly cause unevenness in circulation speed of the conveyor belt 320.

Figure 13:
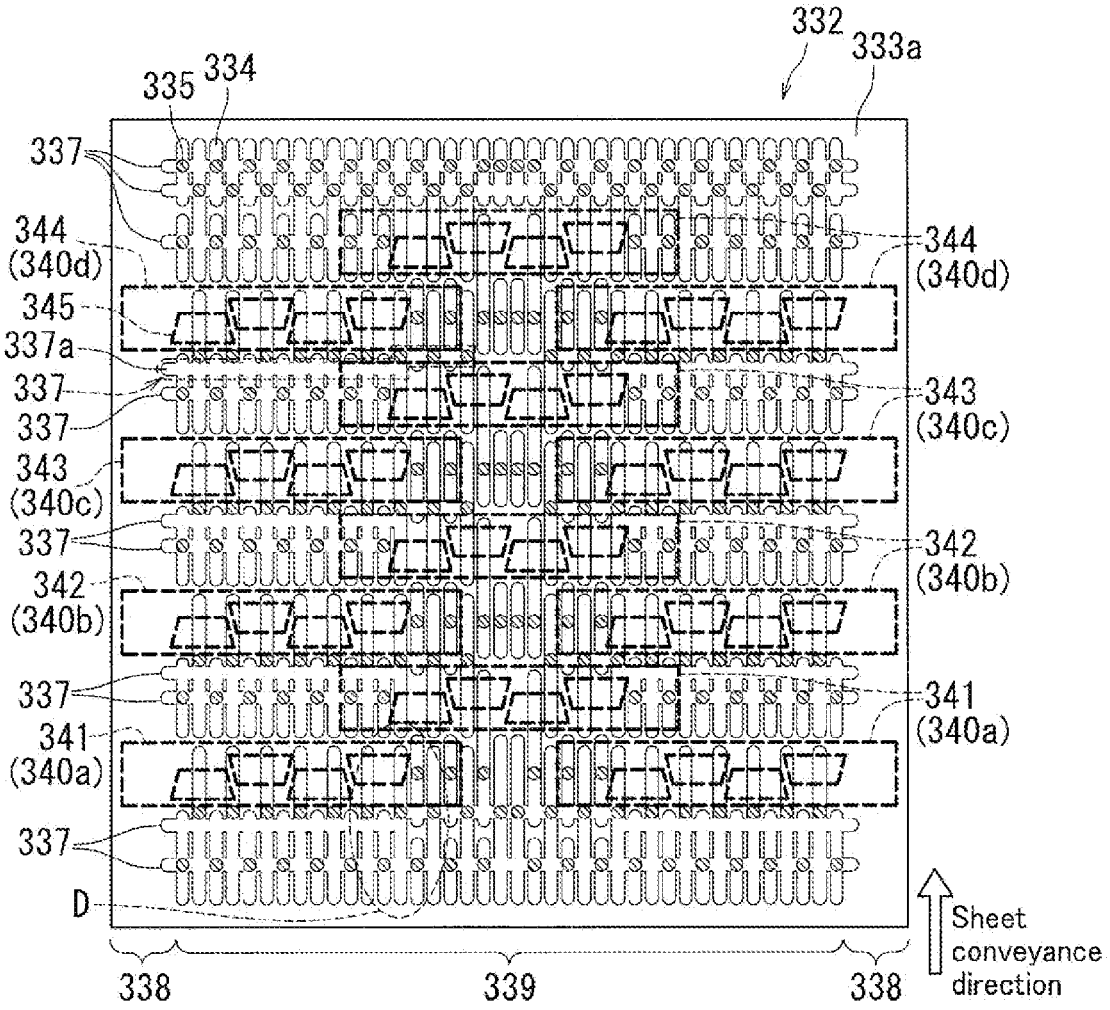
FIG. 13 is a plan view illustrating another variation of the guide member according to the first embodiment of the present disclosure.
Figure 14:
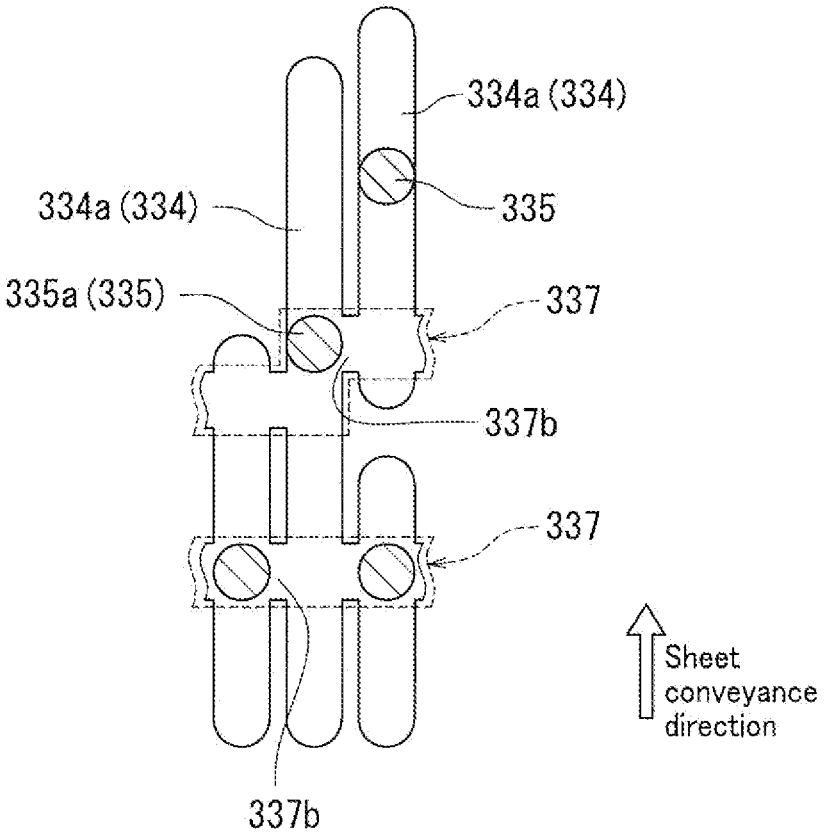
FIG. 14 is a plan view illustrating section D of FIG. 13.

In addition, each of the air escape channels 337 illustrated in FIGS. 2 and 11 extend linearly, but are not limited to having a linear path. FIG. 13 is a plan view of another variation of the guide member 332. FIG. 14 is a plan view illustrating section D of FIG. 13. In other words, FIG. 14 is an enlarged view of a section of the guide member 332 in the other variation. Some of the air escape channels 337 illustrated in FIGS. 13 and 14 each have a stepped part located partway along its path. This configuration can also suppress an excessive increase in negative pressure in the air flow chamber 331 to hardly cause unevenness in circulation speed of the conveyor belt 320.

Second Embodiment

Figure 15:
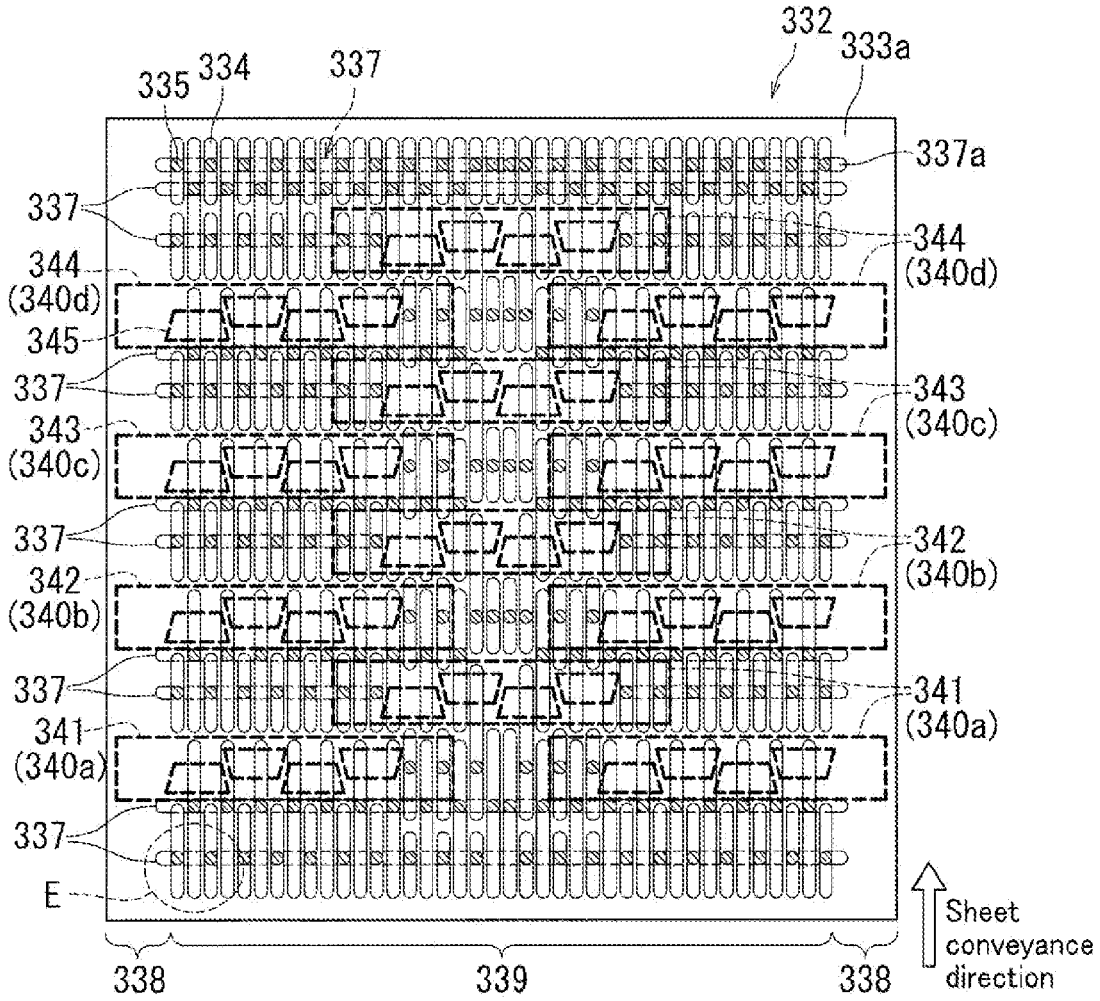
FIG. 15 is a plan view illustrating a guide member according to a second embodiment of the present disclosure.
Figure 16:
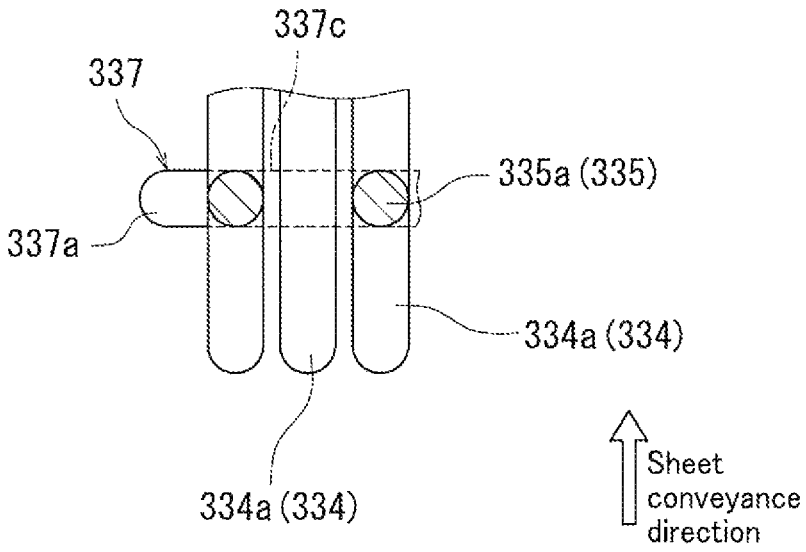
FIG. 16 is a plan view illustrating section E of FIG. 15.
Figure 17:
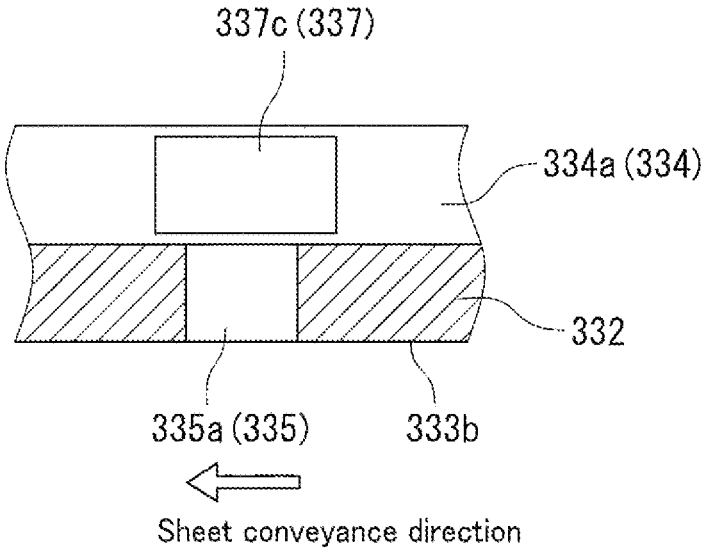
FIG. 17 is a cross sectional view illustrating an air escape channel of the guide member according to the second embodiment of the present disclosure.

The following explains a second embodiment of the present disclosure. FIG. 15 is a plan view illustrating a guide member 332 according to the second embodiment of the present disclosure. FIG. 16 is a plan view illustrating section E of FIG. 15. In other words, FIG. 16 is an enlarged view of a section of the guide member 332 according to the second embodiment. FIG. 17 is a cross sectional view illustrating an air escape channel 337 according to the second embodiment of the present disclosure. Specifically, FIG. 17 illustrates a section where a groove 334*a* intersects with an air escape channel 337 as viewed in the direction perpendicular to the sheet conveyance direction. The second embodiment only differs from the first embodiment in terms of configuration of the guide member 332. The following explains the second embodiment based on differences compared to the first embodiment and omits explanation of matter that is the same as for the first embodiment.

As illustrated in FIGS. 15, 16, and 17, the air escape channels 337 in the second embodiment each include air escape tunnels 337*c*. Each of the air escape tunnels 337*c* is a horizontal tunnel providing communication between grooves 334*a* that are adjacent to each other in terms of the direction perpendicular to the sheet conveyance direction among the plurality of grooves 334. The air escape tunnel 337*c* between the adjacent grooves 334*a* can prevent an excessive increase in negative pressure within the air flow chamber 331 in the same way as explained for the first embodiment, thereby hardly causing unevenness in circulation speed of the conveyor belt 320.

Moreover, the air escape channels 337 in the second embodiment overlap with at least a portion of the through holes 335 (through holes 335*a*), as illustrated in FIG. 15. This can make pressure loss in the air escape channels 337 small, thereby allowing air to flow more readily into the air flow chamber 331 through the air escape channels 337. Note that in a situation in which design requirements restrain the air escape channels 337 from overlapping with the through holes 335, the air escape channels 337 are preferably arranged closely to the through holes 335 as far as possible.

Figure 18:
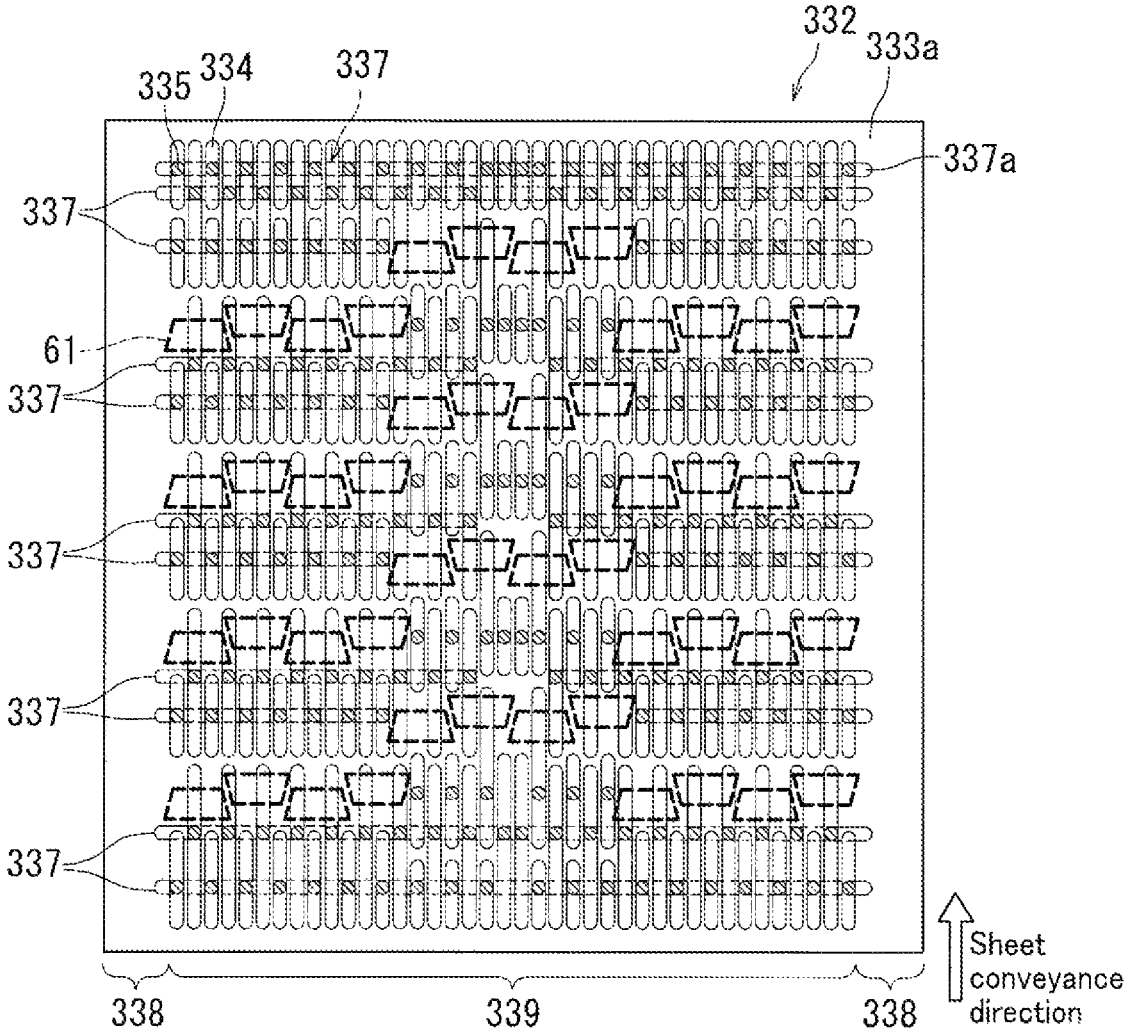
FIG. 18 is a plan view illustrating the guide member according to the second embodiment of the present disclosure.

FIG. 18 is a plan view illustrating the guide member 332 according to the second embodiment of the present disclosure. The air escape channels 337 in the second embodiment are located outside of the nozzle facing regions 61, that is, respective regions that face the respective ejection regions 345 of the recording heads 341, 342, 343, and 344, as illustrated in FIG. 18. This configuration can make suction air flow generated below the ejection regions 345 small. As a result, ink droplets can land on points less deviated from target positions.

Yet further, as illustrated in FIGS. 15 and 18, the air escape channels 337 may extend from one of the end portions 338 to the other end portion 338 of the guide member 332. In this configuration, both the opposite end portions of the air escape channels 337 each are the recess 337*a*. Alternatively, as illustrated in FIGS. 15 and 18, the air escape channels 337 may extend from one of the end portions 338 to the central part of the guide member 332. In this configuration, in the same way as explained for the first embodiment, the center end portions opposite to the recesses 337*a* of the air escape channels 337 are preferably located within a region covered with a minimum-sized sheet P.

Still, in the same way as explained for the first embodiment, the air escape channels 337 (air escape tunnels 337*c*) each preferably have a sectional area greater than the grooves 334 (334*a*) in communication with the air escape channels 337 among the grooves 334.

Furthermore, in the guide member 332 illustrated in FIGS. 15 and 18, the air escape channels 337 extend in the direction perpendicular to the sheet conveyance direction. However, the direction in which the air escape channels 337 extend is not limited in the same way as explained for the first embodiment. It is only required that the air escape channels 337 each intersects with one or more of the grooves 334.

Each path of the air escape channels illustrated in FIGS. 15 and 18 extends linearly but are not limited so in the same way as explained for the first embodiment. For example, the air escape channels 337 each have stepped parts located partway along its path.

Figure 19:
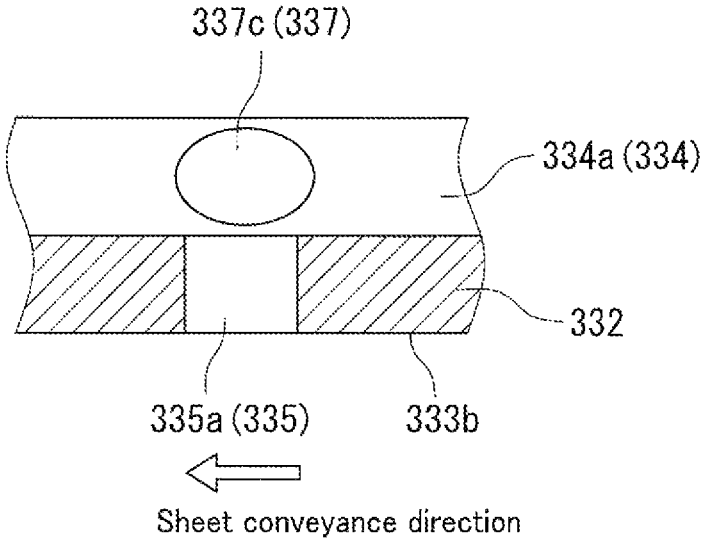
FIG. 19 is a cross sectional view illustrating a variation of the air escape channel of the guide member according to the second embodiment of the present disclosure.

Note that each of the air escape tunnels 337*c* (air escape channels 337) illustrated in FIG. 17 has a rectangular cross-section. However, the air escape tunnels 337*c* each are not limited particularly to having a cross sectional shape. FIG. 19 is a cross sectional view illustrating a variation of the air escape channel 337 (air escape tunnel 337*c*). Specifically FIG. 19 illustrates a section where a groove 334*a* intersects with an air escape channel 337 as viewed in the direction perpendicular to the sheet conveyance direction. As illustrated in FIG. 19, the air escape tunnel 337*c* may have a circular or extended-elliptical shape.

Besides, matter explained in the first and second embodiments may be combined as appropriate. For example, the guide member 332 may have both the air escape channels 337 including the air escape grooves 337*b*, which have been described in the first embodiment, and the air escape channels 337 including the air escape tunnels 337*c*, which have been described in the second embodiment. Alternatively, an air escape channel 337 may include both air escape grooves 337*b* and air escape tunnels 337*c*, for example.

Specific embodiments of the present disclosure are explained above, but the present disclosure is of course not limited to the above embodiments and various alterations can be made to the embodiments.

For example, although the through holes 335 each have a circular cross-section in the embodiments, the cross sectional shape of the through holes 335 is not limited to being circular. The through holes 335 each may have a rectangular cross-section, for example.

The embodiments have been explained for a situation in which the present disclosure is applied to a line head inkjet recording apparatus, but the present disclosure can also be applied to a serial head inkjet recording apparatus.

In the embodiments, three recording heads are arranged for each color in a staggered formation in the direction perpendicular to the sheet conveyance direction, but there is no particular limitation on the number of recording heads for each of the colors. For example, a single recording head may be provided for each of the colors. Also, in a configuration in which a plurality of recording heads are provided for each of the colors, the plurality of recording heads for each of the colors are not limited to being arranged in a staggered formation and may instead be arranged in a single line in the direction perpendicular to the sheet conveyance direction.

The embodiments have been explained for a situation in which the present disclosure is applied to an inkjet recording apparatus that is capable of forming a full-color image, but the present disclosure can also be applied to an inkjet recording apparatus that forms a monochrome image.

Although the embodiments are explained for a situation in which the present disclosure is applied to an inkjet recording apparatus, the present disclosure can also be applied to other image forming apparatuses (e.g., an electrophotographic image forming apparatus).

Furthermore, although the embodiments are explained for a situation in which the recording medium is a sheet of paper, the recording medium may be a medium other than a sheet of paper (e.g., a resin sheet or cloth).

In addition to the alterations explained above, a wide range of other alterations can be made to the embodiments so long as such alterations do not deviate from the intended scope of the present disclosure.

What is claimed is:

1. A conveyor device for installation opposite to a recording head in a recording apparatus, comprising:

a conveyor belt configured to convey a recording medium; and a suction section configured to suck on the recording medium through the conveyor belt and a single plate-shaped guide member of the suction section, the guide member being located opposite to the recording head with the conveyor belt therebetween, the guide member having a plurality of through holes and an air escape channel, wherein the guide member has one surface that faces the recording head with the conveyor belt therebetween, the one surface has a plurality of grooves when viewed from a side of the recording head, the through holes each pass through the guide member in a thickness direction of the guide member, the respective through holes are located inside of the respective grooves when viewing the guide member from the side of the recording head, the air escape channel is in communication with one or more of the grooves, and the one surface has a medium passing region where a recording medium having a maximum size on which the recording apparatus is capable of forming an image passes when viewed from the side of the recording head, the grooves are located only within the medium passing region, the one surface has a recess located only outside the medium passing region in a direction perpendicular to a conveyance direction of the recoding medium and perpendicular to the thickness direction of the guide member when viewed from the side of the recording head, and the recess constitutes a part of the air escape channel.

2. The conveyor device according to claim 1, wherein the air escape channel overlaps with one or more of the through holes.

3. The conveyor device according to claim 1, wherein the air escape channel has a sectional area greater than each of the grooves in communication with the air escape channel among the grooves.

4. The conveyor device according to claim 1, wherein the air escape channel is located outside of a nozzle facing region of the guide member that faces an ejection region of the recording head.

5. The conveyor device according to claim 1, wherein the air escape channel includes an air escape groove providing communication between grooves, among the grooves, that are adjacent to each other in terms of a direction perpendicular to the conveyance direction of the recording medium and perpendicular to the thickness direction of the guide member, the one surface of the guide member further has the air escape groove, the air escape groove is located in the medium passing region when viewing the one surface from the side of the recording head, and the air escape groove is open toward the recording head.

6. The conveyor device according to claim 1, wherein the air escape channel includes an air escape tunnel providing communication between grooves, among the grooves, that are adjacent to each other in terms of a direction perpendicular to the conveyance direction of the recording medium and perpendicular to the thickness direction of the guide member, the air escape tunnel partially passes through the guide member between the adjacent grooves of the grooves, the air escape tunnel is located within the medium passing region when viewing the one surface of the guide member from the side of the recording head, and the air escape tunnel is closed to the recording head.

7. An inkjet recording apparatus comprising:

the conveyor device according to claim 1; and the recording head, wherein the recording head ejects ink droplets.

* * * * *